US009528305B2

(12) United States Patent
Brammer, Jr. et al.

(10) Patent No.: US 9,528,305 B2
(45) Date of Patent: Dec. 27, 2016

(54) RECREATIONAL VEHICLE OPEN ASSIST HANDLE

(71) Applicants: Robert C. Brammer, Jr., Traverse City, MI (US); Charles A. Brammer, Traverse City, MI (US)

(72) Inventors: Robert C. Brammer, Jr., Traverse City, MI (US); Charles A. Brammer, Traverse City, MI (US)

(73) Assignee: STROMBERG CARLSON PRODUCTS, INC., Traverse City, MI (US)

( * ) Notice: Subject to any disclaimer, the term of this patent is extended or adjusted under 35 U.S.C. 154(b) by 315 days.

(21) Appl. No.: 14/207,925

(22) Filed: Mar. 13, 2014

(65) Prior Publication Data

US 2014/0265374 A1 Sep. 18, 2014

Related U.S. Application Data

(60) Provisional application No. 61/791,960, filed on Mar. 15, 2013.

(51) Int. Cl.

| | |
|---|---|
| ***E05B 83/44*** | (2014.01) |
| ***E05B 1/00*** | (2006.01) |
| *E05B 7/00* | (2006.01) |

(52) U.S. Cl.

CPC ..... *E05B 83/44* (2013.01); *E05B 1/0053* (2013.01); *E05B 7/00* (2013.01); *Y10T 292/57* (2015.04)

(58) Field of Classification Search

CPC ..... E05B 1/0053; E05B 83/44; E05B 85/10; E05B 85/14; E05B 85/16; E05B 85/18; E05B 7/00; Y10T 292/57

USPC ..... 292/336.3, 347, 348

See application file for complete search history.

(56) References Cited

U.S. PATENT DOCUMENTS

| | | | | |
|---|---|---|---|---|
| 1,530,696 A * | 3/1925 | Reed | E05B 53/00 | 292/255 |
| 3,144,268 A * | 8/1964 | Rowe | E05B 1/0053 | 292/255 |
| 3,317,231 A * | 5/1967 | Lindquist | E05B 53/00 | 292/336.3 |
| 4,006,927 A * | 2/1977 | Recupero | E05B 1/0053 | 292/336.3 |
| 5,425,155 A * | 6/1995 | Marciniak | E05B 1/0053 | 16/438 |

(Continued)

OTHER PUBLICATIONS

DK Hardware.com, Aluminum Universal Push-Pull Paddle Handle, www.dkhardware.com/paddle-handles-and-lever-handles_ZC1414MOP1.html. [an example of a type of paddle handle]. Jun. 23, 2016.*

*Primary Examiner* — James O Hansen

(74) *Attorney, Agent, or Firm* — Flynn, Thiel, Boutell & Tanis, P.C.

(57) ABSTRACT

A door assist system including a door and a door assist assembly. The door is pivotally attached to a wall. The door has a paddle handle configured to be pivoted about a first pivot axis relative to the door for allowing the door to rotate relative to the wall to open. The door assist assembly includes a bar connected to the door and configured to pivot relative to the door about a second pivot axis. The door assist assembly further includes a handle engagement member connected to the bar and securely engaging the paddle handle. Rotation of the bar about the second pivot axis causes the handle engagement member to rotate the paddle handle about the first pivot axis to allow the door to open.

18 Claims, 3 Drawing Sheets

(56) References Cited

U.S. PATENT DOCUMENTS

| | | | | |
|---|---|---|---|---|
| 5,713,614 | A * | 2/1998 | Anderson | E05B 1/0053 16/413 |
| 6,502,873 | B1 * | 1/2003 | Horseman | E05B 1/0053 16/422 |
| 7,000,958 | B2 * | 2/2006 | Garza | E05C 9/02 16/413 |
| 9,145,713 | B1 * | 9/2015 | Norris | E05B 1/0053 |

* cited by examiner

RECREATIONAL VEHICLE OPEN ASSIST HANDLE

CROSS REFERENCE TO RELATED APPLICATION

This application claims the benefit of U.S. Provisional Application Ser. No. 61/791,960, filed Mar. 15, 2013, which is incorporated herein by reference in its entirety.

FIELD OF THE INVENTION

This invention relates to auxiliary door opening devices, and more particularly to an open assist handle for assisting children and those with poor balance in opening an elevated door on a recreational vehicle or the like.

SUMMARY OF THE INVENTION

In a first aspect of the present invention, a door assist system is provided. The door assist system includes a door and a door assist assembly. The door is pivotally attached to a wall. The door has a paddle handle configured to be pivoted about a first pivot axis relative to the door for allowing the door to rotate relative to the wall to open. The door assist assembly includes a bar connected to the door and configured to pivot relative to the door about a second pivot axis. The door assist assembly further includes a handle engagement member connected to the bar and securely engaging the paddle handle. Rotation of the bar about the second pivot axis causes the handle engagement member to rotate the paddle handle about the first pivot axis to allow the door to open.

Another aspect of the present invention is to provide an improved recreational vehicle having a door pivotally attached to a wall, with the door having a paddle handle configured to be pivoted about a first pivot axis relative to the door for allowing the door to rotate relative to the wall to open. The improvement includes a door assist assembly including a bar connected to the door and configured to pivot relative to the door about a second pivot axis, with the door assist assembly further including a handle engagement member connected to the bar and securely engaging the paddle handle. Rotation of the bar about the second pivot axis causes the handle engagement member to rotate the paddle handle about the first pivot axis to allow the door to open.

Yet another aspect of the present invention is to provide a door assist assembly comprising a curved bar, a top connection member, a bottom connection member and a handle engagement member. The top connection member is connected to the top of the curved bar, with the top connection member being configured to be connected to a door at a first location above a paddle handle of the door. The bottom connection member is connected to a bottom of the curved bar, with the bottom connection member being configured to be connected to the door at a second location below the paddle handle of the door. The handle engagement member is connected to the bar between the top connection member and the bottom connection member, with the handle engagement member being allowed to freely slide on the curved bar. The top connection member and the bottom connection member define a pivot axis for rotation of the curved bar. Rotation of the bar about the pivot axis causes the handle engagement member to slide on the curved bar such that the handle engagement member can rotate the paddle handle to allow the door to open when the handle engagement member is connected to the paddle handle.

DETAILED DESCRIPTION OF PREFERRED EMBODIMENTS

For purposes of description herein, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined herein. Hence, specific dimensions and other physical characteristics relating to the embodiments disclosed herein are not to be considered as limiting, unless expressly stated otherwise.

Figure 1:
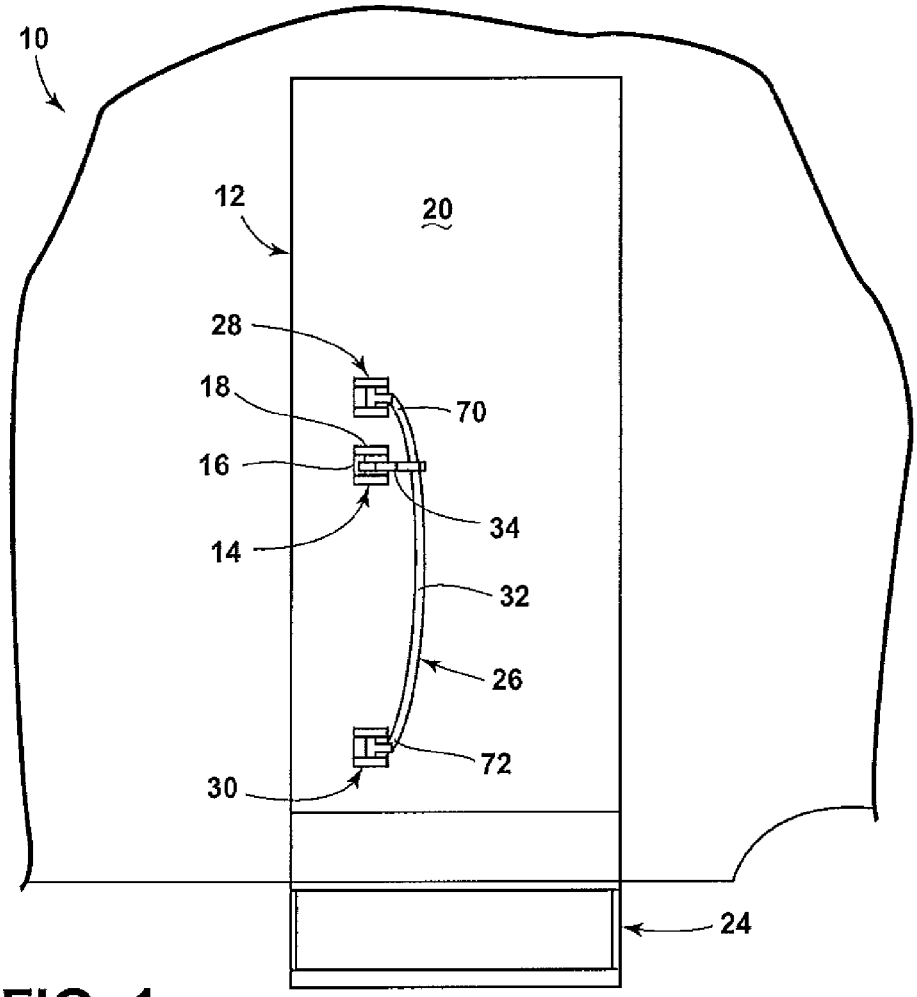
FIG. 1 is a schematic side view of a recreational vehicle having a door, a door handle and an open assist handle of the present invention.

FIG. 1 illustrates a recreational vehicle 10 having a door 12 with a nearly flush door handle 14 known as a paddle handle such as used on recreational vehicles. The door handle 14 has a generally planar member, or paddle 16, which is substantially flush with a face plate 18 on a surface 20 of the door 12. The paddle 16 pivots on a vertical axis 22 (see FIGS. 2-3) to allow the door 12 to open. Since the door 12 and especially the door handle 14 are located above the ground, children and those with poor balance can have a very difficult time actuating the door handle 14 and maintaining their balance to allow them to keep the door 12 open to enter the recreational vehicle 10. Difficulty in opening the door 12 can be increased when the door 12 is located off the ground and the children and those with poor balance must stand on stairs 24 to open the door 12. An open assist handle 26 of the present invention assists children and those with poor balance in opening the door 12 on the recreational vehicle 10 (or the like).

In the illustrated example, the open assist handle 26 engages with the paddle 16 of the door handle 14 to open the door 12. The open assist handle 26 includes a top connection member 28, a bottom connection member 30, a pivoting bar 32 and a handle engagement member 34. The pivoting bar 32 pivots about the top connection member 28 and the bottom connection member 30 to move the handle engagement member 34 to open the door 12. The paddle 16 of the door handle 14 and the handle engagement member 34 substantially pivot about the vertical axis 22 to open the door 12.

Figure 2:
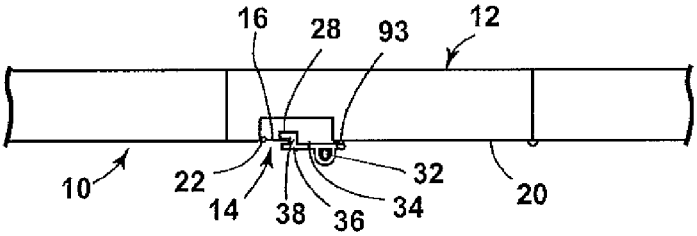
FIG. 2 is a top schematic view illustrating the door, door handle and the open assist handle of the present invention in a closed position.
Figure 3:
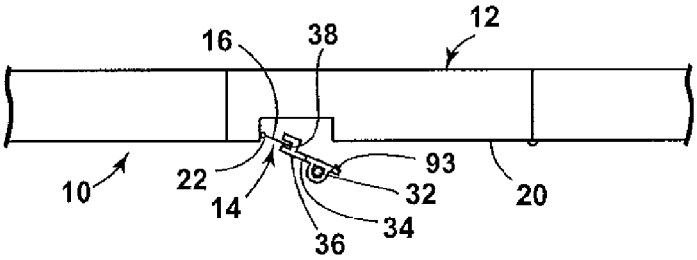
FIG. 3 is a top schematic view illustrating the door, door handle and the open assist handle of the present invention in an open position.
Figure 5:
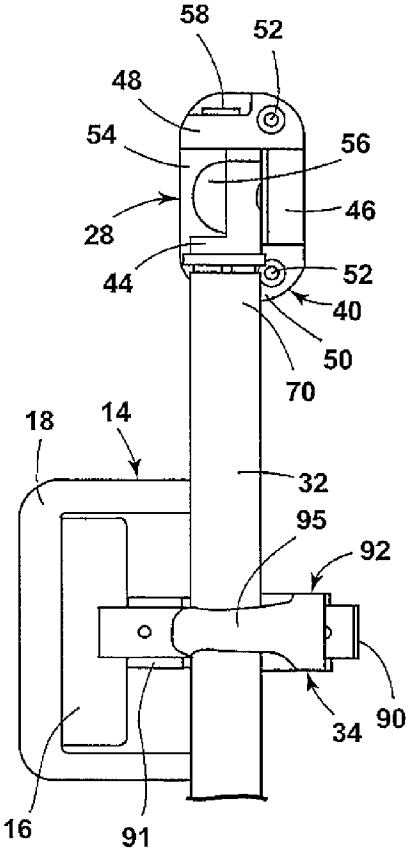
FIG. 5 is a side view of the door, the door handle and the top portion of the open assist handle of the present invention in the open position.
Figure 4:
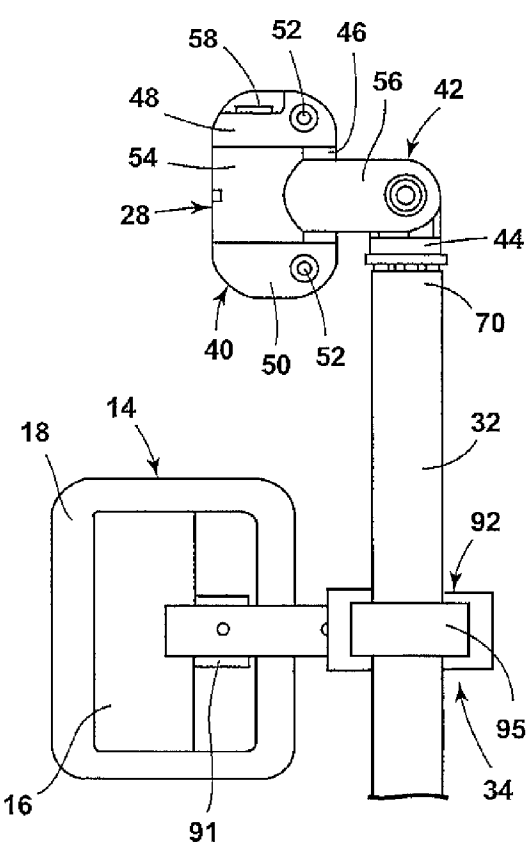
FIG. 4 is a side view of the door, the door handle and a top portion of the open assist handle of the present invention in the closed position.

FIGS. 1, 2 and 4 illustrate the open assist handle 26 of the present invention in the closed position, wherein the door 12 cannot be opened. In the closed position, the paddle 16 is flush with the face plate 18 on the surface 20 of the door 12. A spring or similar member (not shown) connected to the paddle 16 maintains the paddle 16 in the closed position. In the closed position, the pivoting bar 32 is adjacent the surface 20 of the door 12 and the handle engagement member 34 is adjacent or abutting the surface 20 of the door 12. As illustrated in FIG. 2, the handle engagement member 34 includes a gripping member 36 having a paddle receiving slot 38 receiving the paddle 16 therein. When the pivoting bar 32 is pulled away from the surface 20 of the door 12, the pivoting bar 32 will pivot about the top connection member 28 and the bottom connection member 30 to move the handle engagement member 34 away from the surface 20 of the door 12 as illustrated in FIG. 3 to pivot the paddle 16 about the vertical axis 22 to thereby open the door 12 as illustrated in FIGS. 3 and 5.

In the illustrated example, the top connection member 28 and the bottom connection member 30 connect the open assist handle 26 of the door 12. The top connection member 28 includes U-shaped fixed portion 40, a T-shaped pivoting portion 42 and a bar connection post 44. The bottom connection member 30 also includes the U-shaped fixed portion 40, the T-shaped pivoting portion 42 and the bar connection post 44. As discussed in more detail below, the bar connection post 44 is pivotable about the T-shaped pivoting portion 42 such that a single design and parts can be used for forming both the top connection member 28 and the bottom connection member 30, such that only the top connection member 28 will be discussed herein with the understanding that the bottom connection member 30 can be identical in configuration to the top connection member 28. The U-shaped fixed portion 40 includes a base 46 flush with the surface 20 of the door 12 along with a top arm 48 and a bottom arm 50 cantilevered from the base 46. The top arm 48 and the bottom arm 50 include counterbores 52 therein, with the counterbores 52 configured to receive fasteners therein. The fasteners positioned within the counterbores 52 also extend into the door 12 to connect the U-shaped fixed portion 40 to the door 12.

The illustrated T-shaped pivoting portion 42 is configured to pivot within the U-shaped fixed portion 40 of the top connection member 28. The T-shaped pivoting portion 42 includes a cylinder 54 extending between the top arm 48 and the bottom arm 50 of the U-shaped fixed portion 40 and a side arm 56 extending sidewardly from a middle section of the cylinder 54. A fastener 58 extends through the top arm 48 of the U-shaped fixed portion 40, the axis of the cylinder 54 and the bottom arm 50 of the U-shaped fixed portion 40 to pivotally connect the cylinder 54 and therefore the T-shaped pivoting portion 42 to the U-shaped fixed portion 40. The bottom arm 50 can have a polygonal shaped opening 51 for receiving a nut therein for receiving a bottom threaded end of the fastener 58 to connect the fastener 58 to the U-shaped fixed portion 40 and to allow for only a single tool to connect the T-shaped pivoting portion 42 to the U-shaped fixed portion 40.

Figure 6:
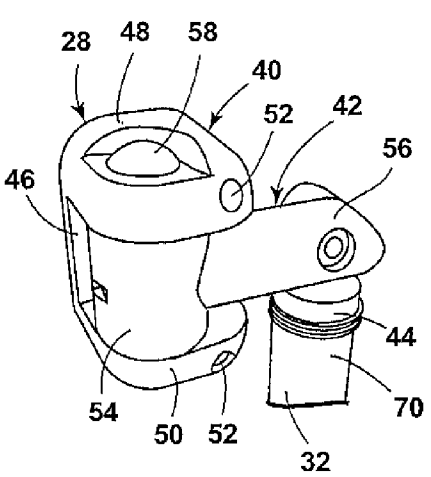
FIG. 6 is a top perspective view of a top portion of the open assist handle of the present invention.
Figure 7:
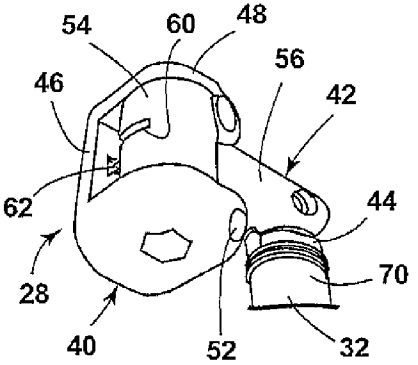
FIG. 7 is a bottom perspective view of a top portion of the open assist handle of the present invention.

As illustrated in FIGS. 6-7, the cylinder 54 can have a radial slot 60 receiving a pin 62 extending from the base 46 of the U-shaped fixed portion 40 to maintain the rotational stability of the cylinder 54. A spring having a first end connected to the T-shaped pivoting portion 42, a middle portion surrounding the fastener 58 extending through the cylinder 54, and a second end fixed to the U-shaped fixed portion 40 biases the side arm 56 of the T-shaped pivoting portion 42 to a position wherein the side arm 56 is substantially perpendicular to the pivot axis of the cylinder 54 in a direction away from the paddle 16 (see FIGS. 1 and 4). In the illustrated example, the bar connection post 44 is freely pivotably about a free end of the side arm 56 of the T-shaped pivoting portion 42. The bar connection post 44 of the top connection member 28 includes a reduced diameter cylinder extending downward and received within a top 70 of the pivoting bar 32. Likewise, the bar connection post 44 of the bottom connection member 30 includes a reduced diameter cylinder extending upwards and received within a bottom 72 of the pivoting bar 32. While a particular configuration of the top connection member 28 and the bottom connection member 30 are shown and described, it is contemplated that the top connection member 28 and the bottom connection member 30 could have other configurations that allow the pivoting bar 32 to pivot about the surface 20 of the door 12, including having different configurations for the top connection member 28 and the bottom connection member 30 (i.e., such that the top connection member 28 and the bottom connection member 30 are different). It is contemplated that the top connection member 28 and the bottom connection member 30 could be made out of any material (e.g., metal and/or plastic). It is contemplated that the top connection member 28 and the bottom connection member 30 could be retrofit to existing recreational vehicles (and the like) or that the doors 12 to recreational vehicles could have the top connection member 28 and the bottom connection member 30 affixed thereto when sold. It is further contemplated that the door 12 can be configured to have integral top connection member 28 and the bottom connection member 30 formed thereon (with the U-shaped fixed portions 40 forming a part of the structure of the door 12).

In the illustrated example, the rotational axes of the cylinders 54 of the T-shaped pivoting portions 42 of the top connection member 28 and the bottom connection member 30 are aligned and co-linear to allow the pivoting bar 32 to pivot. Furthermore, the rotational axes of the cylinders 54 of the T-shaped pivoting portions 42 of the top connection member 28 and the bottom connection member 30 are adjacent the vertical axis 22 of the paddle 16 to allow the paddle 16 to properly pivot when the pivoting bar 32 is pivoted. The pivoting bar 32 can be curved (arcuate) to accommodate the handle engagement member 34 between the pivoting bar 32 and the paddle 16 of the door 12 in the open and the closed position (and anywhere in between). It is contemplated that the pivoting bar 32 could have other configurations (e.g., stepped and/or curved portions between the top 70 and the bottom 72 thereof). The pivoting bar 32 can be made of any material (e.g., plastic and/or metal).

Figure 8:
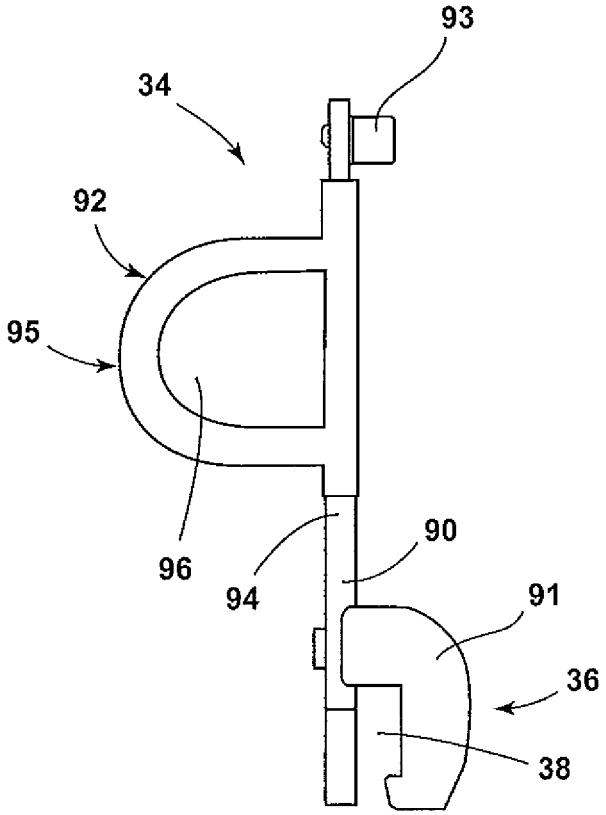
FIG. 8 is a bottom view of a handle engagement member of the open assist handle of the present invention.

The illustrated handle engagement member 34 (FIGS. 4, 5 and 8) is engaged with the pivoting bar 32 of the open assist handle 26 and the paddle 16. The handle engagement member 34 includes a bar 90 and an L-shaped extension 91 forming the gripping member 36 and a ring connector 92 for connecting the handle engagement member 34 to the pivoting bar 32. The bar 90 is a flat plate 94 having the L-shaped extension 91 extending from a first side thereof and the ring connector 92 extending from a second side thereof. The bar 90 can have a rubber stop 93 at the second side thereof, with the rubber stop 93 configured to abut against the surface 20 of the door 12 when the paddle 16 is in the closed position (see FIG. 2). The ring connector 92 has a U-shaped base portion 95 straddling the bar 90 and an arched portion 95 extending from the bar 90 in a direction opposite to the direction of the rubber stop 93. The arched portion 95 includes a central opening 96 receiving the pivoting bar 32 therein. In the illustrated example, the pivoting bar 32 is allowed to freely slide within the central opening 96 of the arched portion 95 of the ring connector 92 of the handle engagement member 34 to allow the handle engagement member 34 to pivot about the pivoting bar 32 as the pivoting bar 32 is rotated. Furthermore, allowing the pivoting bar 32 to freely move within the central opening 96 allows the handle engagement member 34 of the open assist handle 26 to be moved vertically relative to the rest of the open assist handle 26 when the open assist handle 26 is connected to the door 12 to allow for proper alignment of the open assist handle 26. The bar 90 and the L-shaped extension 91 of the handle engagement member 34 forming the gripping member 36 also form the paddle receiving slot 38 for receiving the paddle 16 therein.

In use, the pivoting bar 32 of the open assist handle 26 is grasped near the bottom 72 thereof and pulled away from the surface 20 of the door 12, thereby pivoting the pivoting bar 32 about the rotational axes of the cylinders 54 of the T-shaped pivoting portions 42 of the top connection member 28 and the bottom connection member 30. As the pivoting bar 32 is pivoted from the position shown in FIG. 2 to the position shown in FIG. 3, the ring connector 92 of the handle engagement member 34 will move away from the surface 20 of the door 12, thereby pulling the gripping member 36 holding the paddle 16 therein. As the paddle 16 is pulled, the paddle 16 will pivot about the vertical axis 22, thereby allowing the door 12 to open. Accordingly, a person that cannot reach the paddle 16, but can grasp the pivoting bar 32 near the bottom 72 thereof is able to open the door 12. The person also will not have to stand on the stairs 24 to be able to reach the paddle 16 and not have to risk falling off of the stairs 24 to allow the door 12 to fully open in a path that leads directly over the stairs 24. The open assist handle 26 also does not require a strong grip to open the door 12.

It is to be understood that variations and modifications can be made on the aforementioned embodiments without departing from the concepts of the present invention. Moreover, it is to be understood that such concepts are intended to be covered herein unless expressly stated otherwise.

We claim:

1. A door assist system comprising:

a door pivotally attached to a wall and configured to pivot relative to the wall about a door axis, the door having a paddle handle configured to be pivoted about a first pivot axis relative to the door for allowing the door to rotate relative to the wall to open; and a door assist assembly including a bar connected to the door and configured to pivot relative to the door about a second pivot axis, the door assist assembly further including a handle engagement member connected to the bar and securely engaging the paddle handle;

wherein rotation of the bar about the second pivot axis causes the handle engagement member to rotate the paddle handle about the first pivot axis to allow the door to open; and wherein the door axis, the first pivot axis and the second pivot axis are substantially parallel.

2. The door assist system of claim 1, wherein:

the bar is arcuate.

3. The door assist system of claim 2, wherein:

the handle engagement member is allowed to freely slide on the bar.

4. The door assist system of claim 3, wherein:

the handle engagement member includes a grip member having an adjustable mouth, with the paddle handle being securely gripped within the adjustable mouth; and the handle engagement member further includes a ring connector surrounding the bar.

5. The door assist system of claim 1, wherein:

the door assist assembly further includes a top connection member and a bottom connection member;

the top connection member is connected to a top of the bar, with the top connection member being connected to the door at a first location above the paddle handle of the door; and the bottom connection member is connected to a bottom of the bar, with the bottom connection member being connected to the door at a second location below the paddle handle of the door.

6. The door assist system of claim 5, wherein:

the top connection member and the bottom connection member are identical.

7. The door assist system of claim 5, wherein:

each of the top connection member and the bottom connection member include a U-shaped fixed portion connected to the door, a T-shaped pivoting portion located in a mouth of the U-shaped fixed portion and pivoting therein to define the second pivot axis, and a bar connection post rotatably attached to the T-shaped pivoting portion and the bar.

8. An improved recreational vehicle having a door pivotally attached to a wall and configured to pivot relative to the wall about a door axis, with the door having a paddle handle configured to be pivoted about a first pivot axis relative to the door for allowing the door to rotate relative to the wall to open, the improvement comprising:

a door assist assembly including a bar connected to the door and configured to pivot relative to the door about a second pivot axis, the door assist assembly further including a handle engagement member connected to the bar and securely engaging the paddle handle;

wherein rotation of the bar about the second pivot axis causes the handle engagement member to rotate the paddle handle about the first pivot axis to allow the door to open; and wherein the door axis, the first pivot axis and the second pivot axis axe substantially parallel.

9. The improved recreational vehicle of claim 8, wherein:

the bar is arcuate.

10. The improved recreational vehicle of claim 9, wherein:

the handle engagement member is allowed to freely slide on the bar.

11. The improved recreational vehicle of claim 10, wherein:

the handle engagement member includes a grip member having an adjustable mouth, with the paddle handle being securely gripped within the adjustable mouth; and the handle engagement member further includes a ring connector surrounding the bar.

12. The improved recreational vehicle of claim 8, wherein:

the door assist assembly further includes a top connection member and a bottom connection member;

the top connection member is connected to a top of the bar, with the top connection member being connected to the door at a first location above the paddle handle of the door; and the bottom connection member is connected to a bottom of the bar, with the bottom connection member being connected to the door at a second location below the paddle handle of the door.

13. The improved recreational vehicle of claim 12, wherein:

the top connection member and the bottom connection member are identical.

14. The improved recreational vehicle of claim 12, wherein:

each of the top connection member and the bottom connection member include a U-shaped fixed portion connected to the door, a T-shaped pivoting portion located in a mouth of the U-shaped fixed portion and pivoting therein to define the second pivot axis, and a bar connection post rotatably attached to the T-shaped pivoting portion and the bar.

15. A door assist assembly comprising:

a curved bar;

a top connection member connected to a top of the curved bar, the top connection member being configured to be connected to a door at a first location above a paddle handle of the door;

a bottom connection member connected to a bottom of the curved bar, the bottom connection member being configured to be connected to the door at a second location below the paddle handle of the door; and a handle engagement member connected to the bar between the top connection member and the bottom connection member, the handle engagement member being allowed to freely slide on the curved bar;

the top connection member and the bottom connection member defining a pivot axis for rotation of the curved bar; and wherein rotation of the bar about the pivot axis causes the handle engagement member to slide on the curved bar such that the handle engagement member can rotate the paddle handle to allow the door to open when the handle engagement member is connected to the paddle handle.

16. The door assist assembly of claim 15, wherein:

the handle engagement member includes a grip member having an adjustable mouth, with the paddle handle being configured to be securely gripped within the adjustable mouth; and the handle engagement member further includes a ring connector surrounding the curved bar.

17. The door assist assembly of claim 15, wherein:

the top connection member and the bottom connection member are identical.

18. The door assist system of claim 15, wherein:

each of the top connection member and the bottom connection member include a U-shaped fixed portion configured to be connected to the door, a T-shaped pivoting portion located in a mouth of the U-shaped fixed portion and pivoting therein to define the pivot axis, and a bar connection post rotatably attached to the T-shaped pivoting portion and the bar.

* * * * *